United States Patent [19]

Smith et al.

[11] Patent Number: 5,033,647

[45] Date of Patent: Jul. 23, 1991

[54] VALUE CONTROLLED SQUEEZABLE FLUID DISPENSER

[75] Inventors: Daniel F. Smith; Greg Holland, both of Irvine, Calif.

[73] Assignee: Allergan, Inc., Irvine, Calif.

[21] Appl. No.: 491,304

[22] Filed: Mar. 9, 1990

[51] Int. Cl.[5] ..... B65D 35/22

[52] U.S. Cl. ..... 222/94; 222/212; 222/494

[58] Field of Search ..... 222/92, 94, 105, 107, 222/130, 206, 212, 213, 209, 215, 494, 491, 490

[56] References Cited

U.S. PATENT DOCUMENTS

| | | | |
|---|---|---|---|
| 3,081,006 | 3/1963 | Land | 222/491 X |
| 3,160,329 | 12/1964 | Radic et al. | 222/204 |
| 3,817,416 | 6/1974 | Costa | 222/153 X |
| 4,102,476 | 7/1978 | Loeffler | 222/209 |
| 4,186,882 | 2/1980 | Szczepanski | 222/212 X |
| 4,349,134 | 9/1982 | Schuster et al. | 222/212 |
| 4,409,250 | 9/1984 | Evezich | 222/83.5 |
| 4,561,570 | 12/1985 | Zulauf et al. | 222/494 X |
| 4,699,300 | 10/1987 | Blake | 222/494 |
| 4,706,827 | 11/1987 | Cabernoch et al. | 222/490 X |
| 4,739,906 | 4/1988 | Loturco | 222/212 X |
| 4,760,937 | 8/1988 | Evezich | 222/212 X |
| 4,785,978 | 11/1988 | Kano et al. | 222/494 X |

*Primary Examiner*—Michael S. Huppert
*Assistant Examiner*—Kenneth R. DeRosa
*Attorney, Agent, or Firm*—Poms, Smith, Lande & Rose

[57] ABSTRACT

A squeezable dispenser having main flexible outer container closed off by a top and an inner collapsible flexible fluid containing bladder. A one-way flow valve is provided between the outer container and the inner bladder to prevent the contents of the bladder from contamination from external sources. A vent in the top provides fluid communication between the interior of the container and the exterior thereof. A sealing member overlies the vent and normally closes off the same when the dispenser is squeezed to dispense liquid in the bladder out through the valve.

11 Claims, 2 Drawing Sheets

VALUE CONTROLLED SQUEEZABLE FLUID DISPENSER

BACKGROUND OF THE INVENTION

The invention relates to devices for storing liquids and dispensing the same without contamination.

DESCRIPTION OF THE PRIOR ART

Certain liquids require preservatives to keep them fresh until such liquids are dispensed. Normally, preservatives must be packaged in the containers containing such liquids. In U.S. Pat. No. 4,409,250 to Evezich, a squeezable dispensing apparatus is disclosed. However, in Evezich, the customer is required to make an aseptic connection, then screw the parts together. It is intended to be reusable with a replaceable liner or bladder. This is undesirable in operations where it is necessary to prevent microbial contamination. In U.S. Pat. No. 4,349,134 to Schuster et al., a valved container for dispensing flammable liquids is disclosed. Obviously, Schuster et al. is not concerned with the problem of microbial contamination. There is no liner or bladder nor is there a sealing member between the projection 26 and cap 8. In U.S. Pat. No. 3,160,329 to Radic et al., a dispensing device is described having a valve member 12 which is drawn over a support member 10 having a nipple 20. Radic et al. is also not concerned with microbial contamination since his device is used to dispense toothpaste, cosmetic creams, paints, etc. There is no separate liner or bladder nor is there a separate sealing member with a very small orifice between the nipple 20.

Thus, there exists a need for a squeezable dispenser which can be filled aseptically with a liquid, then used to dispense such liquid in an aseptic manner.

SUMMARY OF THE INVENTION

It is an object of this invention to provide a squeezable dispenser apparatus which can be filled aseptically with a liquid, then used to dispense the liquid in an aseptic manner.

It is a further object of this invention to provide a squeezable dispenser apparatus having a one-way check valve to prevent the liquid contents from being contaminated by external sources:

These and other objects are preferably accomplished by providing a squeezable dispenser having a main flexible outer container and an inner collapsible flexible fluid containing bladder. A one-way flow valve is provided between the outer container and the inner bladder to prevent the contents of the bladder from contamination from external sources.

DESCRIPTION OF THE PREFERRED EMBODIMENT

Figure 1:
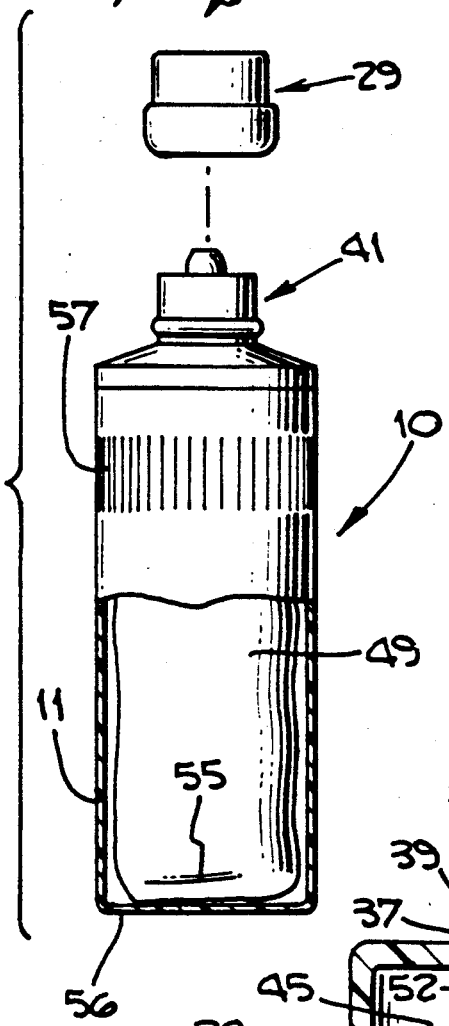
FIG. 1 is a vertical cross-sectional view of a squeezable dispenser apparatus in accordance with the invention.

Referring now to FIG. 1 of the drawing, apparatus 10 is shown comprising a container 11 closed off at the top by a top 12 (FIG. 2) and at bottom by bottom wall 56. Container 11 thus has a neck portion 13 adapted to receive in an annular groove 13*a* an enlarged bead 14*a* on a skirt of top 12 in a fluid tight manner. Skirt portion 14 is integral with a top wall portion 15 terminating in a generally centrally located neck portion 16. Top wall portion 15 has a generally flexible annular ring 17 extending downwardly from, and preferably integral with, inner wall 18 of top wall portion 15. Ring 17 is preferably wider at the base, where it meets inner wall 18, and tapers downwardly to generally a point 19. Ring 17 thus acts to seal top 12 to neck portion 13.

Neck portion 16 includes a first annular groove 23 on the exterior thereof where it meets top wall portion 15, and a second annular groove 24 on the interior thereof. The top of neck portion 16 terminates in top wall 20 having a groove 21 on the inner wall 22 thereof. A vent 28 is provided in top wall 20 communicating the interior of top 12 with the exterior thereof.

A cap 29 snap fits to top 12. Cap 29 has a first generally cylindrical skirt portion 30 with a top wall 31. These portions 30 and 31 may all be of one piece, preferably of resilient material. An annular bead 32 may be provided on the exterior of neck portion 16. The lowermost portion of skirt portion 30 of cap 29 terminates in an inwardly extending flange 33 which snap fits into groove 23 defined by bead 32. A reduced diameter area 34 is provided on skirt portion 30 adjacent flange 33 for breaking off the ring portion 35 of skirt portion 30 when it is desired to use the apparatus 10.

A depression 38 is provided in generally the center of the outside of top wall 31 aligned with an inwardly extending concave portion 39 formed on the inner wall 40 of top wall 31. A bell-shaped portion 36, having a generally centrally located aperture 37, closes off the upper end of top 12. The aperture 37 in top 12 is closed off by a nozzle assembly 41 having a generally cylidrical elongated portion 42 with an exterior annular bead 42*a* snap fitting into groove 24. An integral generally horizontal apertured flange 43 is also provided on nozzle assembly 41 having openings 44 therein. A sealing member 45 is centrally located on flange 43 extending upwardly therefrom. An elastomeric seal 46 is provided between top 12 and nozzle assembly 41. An opening 48 is provided on the upper end of seal 46. Seal 46 is trapped and compressed between portion 36 and flange 43. Concave portion 39 bears against and normally seals off opening 48 with sealing member 45 also bearing against and sealing off the opening 48. That is, concave portion 39 and sealing member 45 cooperate to normally close off opening 48. Sealing member 46 has a generally flat annular apertured flange portion 51 and an integral upper bell shaped portion 52. Flat portion 51 has an enlarged annular bead 53 adapted to conform to and fit into annular groove 21 on wall 20 and into a like annular groove 54 on flange 43.

Figure 2:
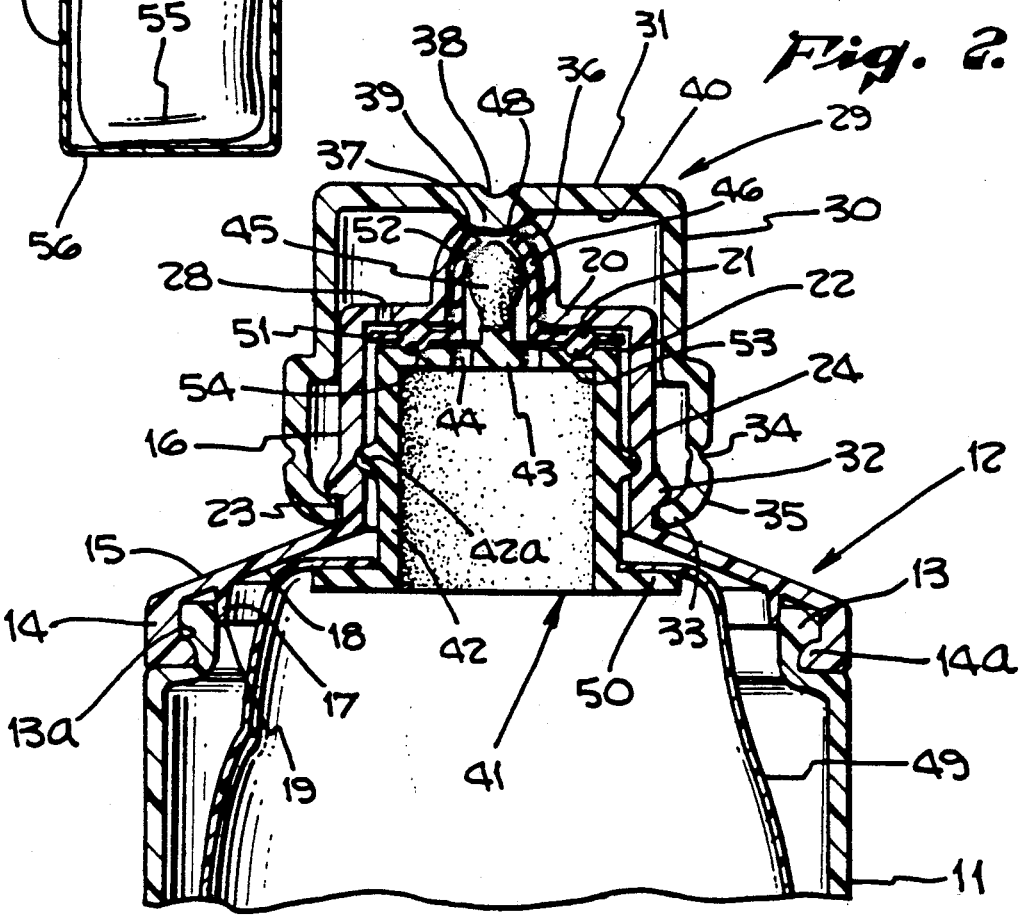
FIG. 2 is a vertical view, partly in section, of a portion of the apparatus of FIG. 1.

As seen in FIGS. 1 and 2, and as particularly contemplated in the invention, a collapsible liner 49 is provided on the interior of container 11 and is sealed to an annular apertured flange 50 integral with the bottom of cylindrical portion 42 in a fluid tight manner, such as by heat sealing thereto.

Any suitable materials may be used. Container 11 is preferably of a flexible material, such as polyethylene, which can be squeezed or compressed. Liner 49 is also of a suitable flexible and collapsible material, such as polyethylene, or a lamination of metallized oriented polypropylene and ethylene-propylene copolymer. The latter is particularly suited for solutions requiring high gas or moisture barrier.

Nozzle 41 is preferably of a flexible material, such as an elastomeric material, as is sealing member 46, with nozzle 41 having rigid sealing flange 43 and sealing member 45 integral therewith. Cap 29 may also be of plastic material and acts as a tamper-proof overcap both protecting the nozzle 41 and seal 46 from physical damage and preventing accidental dispensing of fluid from liner 49 by concave portion 39 bearing down on the upper end of bell-shaped portion 52 of seal 46. Thus, portion 35 acts as a peel-away ring which can be torn off at hinge 34 and peeled off to also remove cap 29.

Container 11 can be injection molded. Liner 49 is provided with an opening 55 in the bottom thereof which, as seen in FIG. 1, is normally open then used to fill liner 49 with a liquid and subsequently heat sealed closed.

Liner 49 is filled with a suitable liquid through opening 55, which is then heat sealed to seal the same. Container 11 can now be secured to top 12 with cap 29 snapped into place, concave portion 39 sealing off opening 48. When it is desired to dispense liquid from liner 49, cap 29 is peeled away as heretofore discussed.

Figure 3:
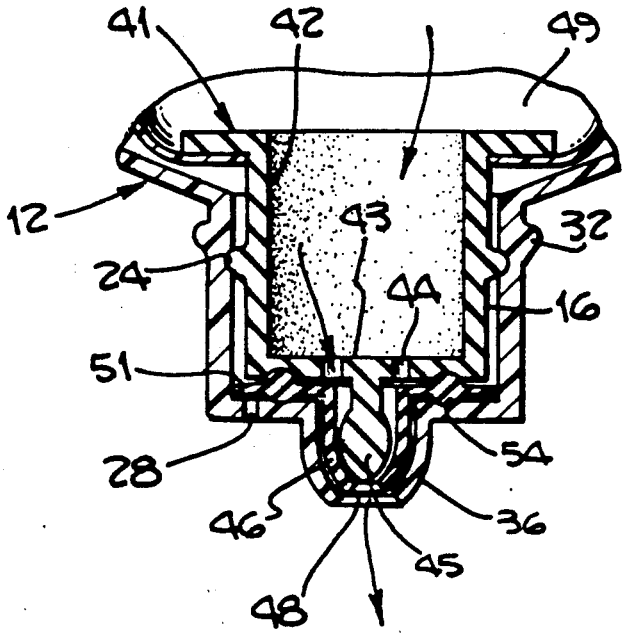
FIG. 3 is an enlarged view of a portion of the apparatus of FIG. 2, the top removed for convenience of illustrating the operation thereof.

Apparatus 10 is then inverted as seen in FIG. 3 and squeezed. Flat portion 51 of seal 46 seals off the vent hole 28 and liquid flows from liner 49 through cylindrical portion 42, through openings 44 of nozzle 41, about sealing member 45, out opening 48 through seal 46, and out opening 37. After such inversion, apparatus 10 is then reinverted, and air enters via vent 28, returning container 11 back to its original configuration.

The combination of liner 49, valve 41 and seal 46 forms a barrier to microbial contamination, thus allowing liquids that normally require preservatives to be packaged without a preservative. Another advantage is that the very small volume of the opening 48 in seal 46 reduces the chance for microbial contamination.

The vent 28 can, of course, be located at any desired location on container 11 and allows air to be drawn in between container 11 and liner 49, thus allowing container 11 to return to its original shape.

The size and shape of container 11 may, of course, be varied. Liner 49 can be attached to flange 50 in any suitable manner. If desired, grasping means, such as textured areas or ribs 57 (FIG. 1) may be provided about the exterior of container 11 to facilitate grasping.

In manufacturing apparatus 10, container 11 and liner 49 may be one integral piece and disposable after use. Alternatively, container 11 could be independent of the liner 49 and nozzle assembly 41.

Figure 5:
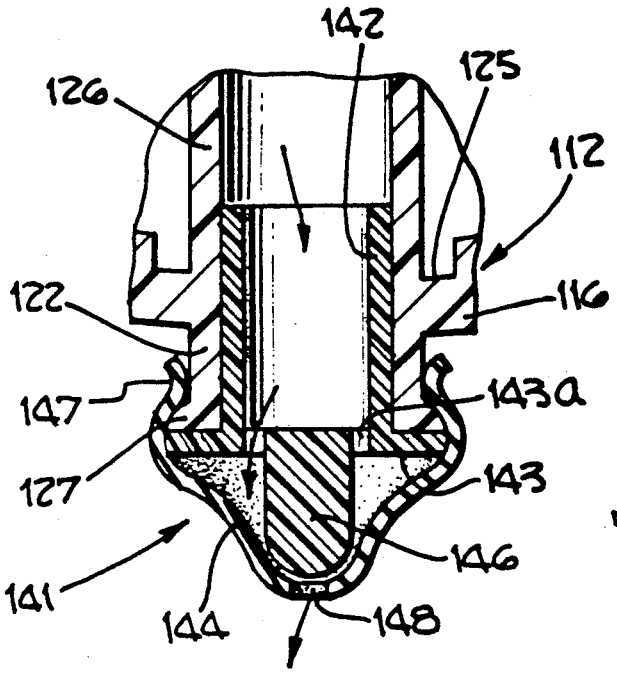
FIG. 5 is an enlarged view of a portion of the top removed for convenience of illustration of the apparatus of FIG. 4 illustrating the operation thereof.
Figure 4:
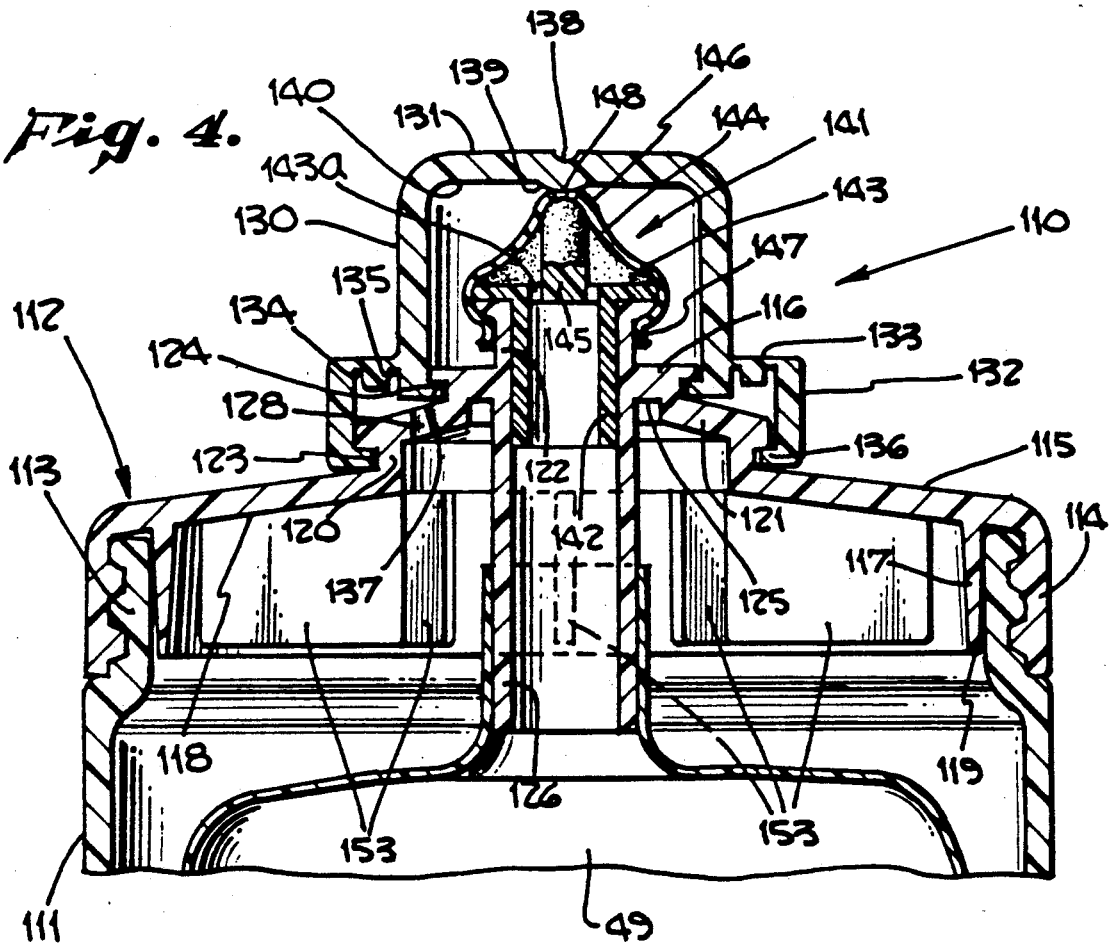
FIG. 4 is a vertical cross-sectional view of a modification of the upper portion of the apparatus of FIG. 1.

Thus, as seen in FIGS. 4 and 5, another embodiment of the invention is disclosed.

Referring now to FIG. 4 of the drawing, apparatus 110 is shown comprising a liquid container 111 closed off at the top by a screw-threaded top 112. Container 111 thus has a threaded neck portion 113 adapted to threadably engage a peripheral threaded skirt portion 114 on top 112 in a fluid tight manner. Skirt portion 114 is integral with a top wall portion 115 terminating in a generally centrally located neck portion 116. Top wall portion 115 has a generally flexible annular ring 117 extending downwardly from, and preferably integral with, inner wall 118 of top wall portion 115. Ring 117 is preferably wider at the base where it meets inner wall 118 and tapers downwardly to generally a point 119. Ring 116 thus acts to seal top 112 to neck portion 113.

Neck portion 116 comprises a generally centrally located first cylindrical portion 120 having an arcuate top wall portion 121 integral with a second cylindrical portion 122. A first annular groove 123 is provided on the exterior of first cylindrical portion 120, where it meets top wall portion 115, and a second annular groove 124 is provided in top wall portion 121. It can be seen that top wall portion 121 is enlarged on the upper surface to provide for groove 124 and stepped on the interior thereof at step portion 125 adjacent an elongated tubular portion 126, which may be a continuation of second cylindrical portion 122 (and, preferably of the same diameter throughout). The top of second cylindrical portion 122 terminates in an enlarged flanged inlet 127 as shown.

A vent 128 is provided in top wall portion 121 communicating the interior of top 112 with the exterior thereof. As seen, vent 128 may be wider at the interior of top wall portion 121 than at the exterior thereof.

A cap 129 snap fits to top 112. Cap 129 has a first generally cylindrical skirt portion 130 with a top wall 131 and a second generally cylindrical skirt portion 132. These portions 130, 131 and 132 may all be of one piece, preferably of resilient material, and skirt portion 132 may be resiliently secured to skirt portion 130 by a flange 133 with living hinge portion 134 between skirt portion 132 and flange 133, on one hand, and living hinge portion 135 between skirt portion 130 and flange 133 on the other hand.

The second cylindrical portion 132 terminates at bottom in an inwardly extending peripheral flange 136 which snap fits into groove 123. The first cylindrical portion 130 terminates at bottom in an inwardly extending peripheral flange 137 which snap fits into groove 124. A depression 138 is provided in generally the center of the outside of top wall 131 aligned with an inwardly extending concave portion 139 formed on the inner wall 140 of top wall 131.

The open end of cylindrical portion 122 is closed off by a nozzle 141 having a generally cylindrical elongated portion 142, of an outer diameter generally related to the inner diameter of portion 122 and tubular portion 126 and fitting therein, and an integral generally horizontal apertured flange 143 having apertures 143*a* therethrough overlying the enlarged flange 127 of cylindrical portion 122. A bell-shaped nozzle sealing tip, 144, which may be of elastomeric material, is provided overlying a flange 143, which may be of a rigid polyethylene material. Flange 143 has an integral sealing member 145 mounted in the open upper end of cylindrical portion 142. As seen, tip 144 extends over the upper rounded portion 146 of sealing member 145 overlying the same, and extends downwardly therefrom and curves about and under flange 143 (terminating in an annular bead 147 snap fitting under flange 127). An opening 148 is provided at the upper end of nozzle 141 communicating the interior thereof with the exterior. Concave portion 139 bears against and normally seals off opening 148 with sealing member 145 also bearing against and sealing off the opening 148. That is, concave portion 139 and sealing member 145 cooperate to normally close off opening 148.

A plurality of spaced radially extending planar ribs 153 are provided integral with the inner wall 118 of top wall portion 115, such as by molding, for reasons to be discussed. Collapsible liner 49 in FIG. 4 is identical to liner 49 of the embodiment of FIGS. 1 to 3, and is provided on the interior of container 111, sealed to the bottom of tubular portion 126 in a fluid tight manner, such as by heat sealing. Any suitable materials may be used. Container 111 is also preferably of a flexible material, such as polyethylene, which can be squeezed or compressed. Liner 49 in the embodiment of FIG. 4 also has an opening, as opening 55, in the embodiment of FIGS. 1 to 3, for filling the same in the identical manner as heretofore described and further discussion or description is deemed unnecessary. Also, tip 144 and flange 143 could be removed and liner 49 filled from the top, if desired. Of course, in this filling option, opening 55 would not be required.

Nozzle 141 is preferably of a flexible material, such as an elastomeric material, comprised of a rigid sealing flange 143 and integral sealing member 145 closing off the open upper flanged end 143. Sealing tip 144 overlies member 145 and flange 143. Cap 129 may also be of plastic material and again acts as a tamper-proof overcap both protecting the nozzle 141 from physical damage and preventing accidental dispensing of fluid from liner 49 by concave portion 139 bearing down on the rounded portion 146 of member 145. Thus, portion 132 acts as a peel-away ring which can be torn off at hinges 134, 135 and peeled off to also remove cap 129. Of course, no such ring need be provided and cap 129 may merely be removable by de-engagement from top 112.

Container 111 can be injection molded and ribs 153 keep any liquid solution in liner 49 from falling or dropping to a place where such liquid can't be dispensed. That is, when container 111 is inverted to dispense liquid, as seen in FIG. 5, the liquid filled liner 49 falls onto and about ribs 153 which thus separates the liner 49 which prevents the liquid therein from dropping to a place from which it can't be dispensed.

In operation, with liner 49 heat sealed to tubular portion 126, liner 49 is filled with a suitable liquid through opening 55 which is then heat sealed as previously discussed. Nozzle 141 is thus placed into inlet 127, as seen in FIG. 4. Cap 129 is snapped into place with concave portion 139 sealing off opening 148. When it is desired to dispense liquid from liner 49, cap 129 is removed as heretofore discussed. Apparatus 110 is then inverted and squeezed as seen in FIG. 5, and liquid flows from liner 49 through tubular portion 126, into portion 142 of nozzle 141, through apertures **143*a*, about sealing member 145, and out hole 148. After such inversion, apparatus 110 is then re-inverted, and air enters vent 128 returning container 111** back to its original configuration.

The combination of the ribs 153, liner 49 and valve 141 forms a barrier to microbial contamination, thus allowing liquids that normally require preservatives to be packaged without a preservative. Another advantage is that the very small volume of the opening 148 in valve 141 reduces the chance for microbial contamination.

The vent 128 can, of course, be located at any desired location on container 111 and allows air to be drawn in between container 111 and liner 49, thus allowing container 111 to return to its original shape.

The size and shape of container 111 may, of course, be varied. Liner 49 can be attached to tubular portion 126 in any suitable manner. If desired, grasping means, such as textured areas or ribs 57, as in the embodiment of FIGS. 1 to 3, may be provided about the exterior of container 111 to facilitate grasping.

Valve 141 may, of course, be fitted to flanged end 127 in any suitable manner. In manufacturing apparatus 110, container 111 and liner 49 may be one integral piece and disposable after use. Alternatively, container 111 could be independent of the liner 49 with liner 49 attached thereto in any suitable manner and nozzle 141 snapped into place or otherwise used to close off the open flanged end 127.

Figure 6:
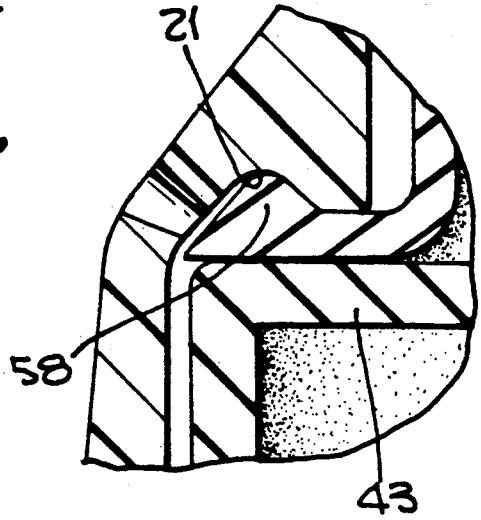
FIG. 6 is a detailed cross-sectional view of a modification of a portion of the apparatus of FIGS. 2 and 3.

In the embodiment of FIGS. 1 to 3, the bead 53 is shown as round. However, as seen in FIG. 6, wherein like numerals refer to like parts of the embodiment of FIGS. 1 to 3, bead 53 may be replaced by a semi-circular bead 58. A seal is provided between bead 58, groove 21 and top flange 43.

It can be seen that there is disclosed squeezable dispensers having a valve sealing off the dispenser outlet. A protective cap 29, 129 holds the seal 46 or nozzle 141 tightly against the projection or sealing member 45, 145. Squeezing of container 11, 111 causes the seal 46 or nozzle 141 to move away from sealing member 45 or 145 so that liquid from liner 49 can flow out of hole 48, 148. The liner 49 can be filled with a liquid aseptically and then such liquid can be dispensed therefrom in an aseptic manner. The combination herein results in a one-way flow or check preventing the contents of liner 49 from being contaminated by external sources.

We claim:

1. A squeezable dispenser comprising:

a main body portion having an opening at the upper end thereof;

a top secured to said main body portion closing off the opening at the upper end thereof and having an opening at the upper end thereof, said top having a vent therein communicating the interior of said dispenser with the exterior thereof;

a resilient valve mounted in said top, said valve having a projection extending upwardly from an integral apertured flange and a downwardly extending main body portion integral with said flange;

a flexible collapsible liner associated with said valve and secured to said top; and a resilient sealing member having an aperture therethrough, said projection normally engaging said sealing member aperture with said sealing member overlying said projection, said sealing member cooperating with said projection to normally close off the opening in said top when said projection engages said sealing member aperture, said sealing member overlying said vent and normally closing off said vent when said dispenser main body portion is squeezed to dispense liquid in said liner out through said valve.

2. In the dispenser of claim 1 wherein said sealing member is loosely disposed between said projection and the opening in said top.

3. In the dispenser of claim 2 wherein said sealing member is a bell-shaped flexible member having a generally centrally located aperture with a generally flat annular portion integral with and surrounding said sealing member aperture.

4. In the dispenser of claim 3 wherein said apertured flange has an upper surface and a lower surface and said top has an outer wall and an inner wall, said flat annular portion having a generally round annular bead received in mating annular grooves in the inner wall of said top and the upper surface of said apertured flange.

5. In the dispenser of claim 3 wherein said flat annular portion has an upper surface and a lower surface, said apertured flange having an upper surface and a lower surface and said top having an outer wall and an inner wall, said flat annular portion having a generally rounded protrusion on its upper surface and being generally flat on its lower surface, said protrusion being received in a mating annular groove on the inner wall of said top.

6. In the dispenser of claim 1 including a removable cap normally closing off the opening in said top.

7. In the dispenser of claim 6 wherein said cap has an inner wall and an outer wall, and a generally centrally located protrusion on the inner wall of said cap normally bearing against and closing off the opening in said top wall and the aperture in said sealing member.

8. In the dispenser of claim 6 including a break-off ring on said cap engaging said top and normally securing said cap to said top.

9. In the dispenser of claim 1 wherein said liner is heat sealed to the main body portion of said valve.

10. In the dispenser of claim 9 wherein the main body portion of said valve terminates in an annular flange, said liner being heat sealed thereto.

11. In the dispenser of claim 1 wherein said top has an inner wall and an outer wall, said main body portion of said valve being generally cylindrical having an inner surface and an outer surface with an annular bead on the outer surface, said annular bead being receivable in an annular groove on the inner wall of said top.

* * * * *

UNITED STATES PATENT AND TRADEMARK OFFICE

CERTIFICATE OF CORRECTION

PATENT NO. : 5,033,647
DATED : July 23, 1991
INVENTOR(S) : Daniel F. Smith and Greg Holland It is certified that error appears in the above-identified patent and that said Letters Patent is hereby corrected as shown below:

On the title page:
In the Title, please change "VALUE" to --VALVE--; and

Under Inventors, please change "Greg Holland" to -Gregory R. Holland-.

Signed and Sealed this

Seventeenth Day of November, 1992

*Attest:*

DOUGLAS B. COMER

*Attesting Officer*

*Acting Commissioner of Patents and Trademarks*